US009079062B2

(12) United States Patent
Thomas

(10) Patent No.: US 9,079,062 B2
(45) Date of Patent: Jul. 14, 2015

(54) PORTABLE EXERCISE DEVICE AND METHOD OF USING THE SAME

(71) Applicant: Karl Thomas, Scarsdale, NY (US)

(72) Inventor: Karl Thomas, Scarsdale, NY (US)

( * ) Notice: Subject to any disclaimer, the term of this patent is extended or adjusted under 35 U.S.C. 154(b) by 218 days.

(21) Appl. No.: 13/755,290

(22) Filed: Jan. 31, 2013

(65) Prior Publication Data

US 2013/0203567 A1 Aug. 8, 2013

Related U.S. Application Data

(60) Provisional application No. 61/593,971, filed on Feb. 2, 2012, provisional application No. 61/709,441, filed on Oct. 4, 2012.

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 23/035*** | (2006.01) |
| *A63B 21/00* | (2006.01) |
| *A63B 21/16* | (2006.01) |
| *A63B 22/02* | (2006.01) |
| *A63B 23/04* | (2006.01) |

(52) U.S. Cl.

CPC ..... *A63B 21/02* (2013.01); *A63B 21/00043* (2013.01); *A63B 21/00065* (2013.01); *A63B 21/0442* (2013.01); *A63B 21/0552* (2013.01); *A63B 21/1419* (2013.01); *A63B 21/1449* (2013.01); *A63B 23/03541* (2013.01); *A63B 21/00185* (2013.01); *A63B 21/0557* (2013.01); *A63B 21/143* (2013.01); *A63B 21/1415* (2013.01); *A63B 21/1426* (2013.01); *A63B 21/1663* (2013.01); *A63B 22/02* (2013.01); *A63B 23/047* (2013.01); *A63B 2209/10* (2013.01); *A63B 2210/50* (2013.01)

(58) Field of Classification Search

CPC .... A63B 21/02; A63B 21/055; A63B 21/065; A63B 21/0552; A63B 21/0555; A63B 21/0556; A63B 21/0557

USPC ..... 482/92, 122, 124, 125, 126, 121; D21/692

See application file for complete search history.

(56) References Cited

U.S. PATENT DOCUMENTS

| | | | | |
|---|---|---|---|---|
| 1,402,179 | A * | 1/1922 | Piscitelli | 482/124 |
| 2,498,006 | A | 2/1950 | Ridill | |
| 3,815,904 | A | 6/1974 | Weiss et al. | |
| 4,071,241 | A * | 1/1978 | Cortes Garcia | 473/424 |

(Continued)

FOREIGN PATENT DOCUMENTS

| | | |
|---|---|---|
| KR | 20-0219913 | 4/2001 |

*Primary Examiner* — Loan H Thanh
*Assistant Examiner* — Nyca T Nguyen
(74) *Attorney, Agent, or Firm* — Leason Ellis LLP

(57) ABSTRACT

According to one embodiment, an exercise device in the form of an adjustable resistance multi-use toning system that includes a plurality of elongated elastic bands (tension bands or cables) which can have different tension (resistance) values. Each band has a first end and an opposing second end. The device further includes a hollow sleeve that receives at least a portion of each of the elastic bands so as to at least partially envelope the elastic bands while permitting the first and second ends to be accessible. A first fastener is provided for attaching the first ends of the elastic bands to a support member, such as a piece of exercise equipment, a belt to be worn around a body part of a user; or any other structure to which the exercise device can be attached.

10 Claims, 9 Drawing Sheets

(56) References Cited

U.S. PATENT DOCUMENTS

| | | | | | |
|---|---|---|---|---|---|
| 4,251,071 | A | | 2/1981 | Norton | |
| 4,852,874 | A | | 8/1989 | Sleichter, III et al. | |
| 4,867,444 | A | * | 9/1989 | Castillo | 482/106 |
| 5,176,602 | A | | 1/1993 | Roberts | |
| D350,795 | S | | 9/1994 | Barbour | |
| 5,362,295 | A | | 11/1994 | Nurge | |
| 5,405,305 | A | | 4/1995 | Wilkinson et al. | |
| 5,431,610 | A | | 7/1995 | Miller | |
| 5,584,783 | A | | 12/1996 | Hagg et al. | |
| 5,681,248 | A | * | 10/1997 | Vani | 482/126 |
| 5,885,196 | A | * | 3/1999 | Gvoich | 482/125 |
| 6,110,075 | A | | 8/2000 | Woodruff | |
| 6,224,518 | B1 | | 5/2001 | Weiss et al. | |
| 6,238,324 | B1 | | 5/2001 | MacMillan | |
| D455,185 | S | * | 4/2002 | Karadimas | D21/692 |
| 6,691,318 | B1 | * | 2/2004 | Davis | 2/102 |
| 6,921,357 | B2 | | 7/2005 | Basting | |
| 7,137,935 | B2 | | 11/2006 | Clarke et al. | |
| 7,175,574 | B2 | | 2/2007 | Carmel et al. | |
| 7,322,907 | B2 | | 1/2008 | Bowser | |
| 7,344,485 | B1 | * | 3/2008 | Simpson et al. | 482/126 |
| 7,727,131 | B2 | | 6/2010 | Longo | |
| 7,775,936 | B2 | | 8/2010 | Wilkinson | |
| 7,819,787 | B2 | | 10/2010 | Kassel | |
| 8,434,824 | B2 | * | 5/2013 | Spinabella et al. | 297/423.1 |
| 2002/0187884 | A1 | | 12/2002 | Mcgrath | |
| 2004/0157710 | A1 | | 8/2004 | Basting | |
| 2004/0180767 | A1 | | 9/2004 | Carmel et al. | |
| 2005/0170937 | A1 | | 8/2005 | Van Straaten | |
| 2006/0084556 | A1 | | 4/2006 | Payne | |
| 2008/0108486 | A1 | | 5/2008 | Vigilia | |
| 2008/0139369 | A1 | | 6/2008 | Vigilia | |
| 2009/0062087 | A1 | * | 3/2009 | Poppinga | 482/124 |

* cited by examiner

PORTABLE EXERCISE DEVICE AND METHOD OF USING THE SAME

CROSS REFERENCE TO RELATED APPLICATION

The present invention claims priority to U.S. patent application Ser. No. 61/593,971, filed Feb. 2, 2012; and U.S. patent application Ser. No. 61/709,441, filed Oct. 4, 2012, each of which is hereby incorporated by reference in its entirety. The present invention is also related to U.S. patent application Ser. No. 13/353,721, which was filed Jan. 19, 2012 and U.S. patent application Ser. No. 13/355,299, filed Jan. 20, 2012, each of which is hereby incorporated by reference in its entirety.

TECHNICAL FIELD

The present invention relates to exercises devices, and, more particularly, to an adjustable resistance multi-use toning system that includes a number of interchangeable parts including one or more elongated resistance bands or cords (cables) that are contained within an elongated sleeve and connectors that permit attachment of the bands to a variety of different support members, including parts of a human body, gym equipment, etc., and allow different accessories to be attached to the bands.

BACKGROUND

As exercising has become more popular, there are more and more different types of exercise devices on the market to meet the needs and desires of individuals. For example, exercise devices can range from small portable devices to large fixed structures and also can be designed to exercise a specific body part or provide the user with an entire body workout.

Many of these systems provide satisfactory results; however, they also have associated disadvantages including size, bulkiness, and limitations on the number and variety of exercises possible. Further, the devices can be very expensive and complex to assemble and use. In clinical and in home settings, it is often not desirous to occupy a room with large exercise equipment.

There is therefore a need for an exercise device that can be easily customizable and attached and secured to any number of different support members, including a piece of exercise equipment or a body part, thereby offering the user not only the ability to use the exercise equipment but also perform physical toning exercises and the like at the same location and in some instances at the same time. The exercise devices of the present invention provide a solution to this need.

SUMMARY

According to one embodiment, an exercise device in the form of an adjustable resistance multi-use toning system that includes a plurality of elongated elastic bands (tension bands or cables) which can have different tension (resistance) values. Each band has a first end and an opposing second end. The device further includes a hollow sleeve that receives at least a portion of each of the elastic bands so as to at least partially envelope the elastic bands while permitting the first and second ends to be accessible.

A first fastener is provided for attaching the first ends of the elastic bands to a support member, such as a piece of exercise equipment, a belt to be worn around a waist of a user or other body part; or any other structure to which the exercise device can be attached. The first fastener is openable and closeable and is adjustable along at least one dimension so as to permit the first fastener to attach to different sized support members. The first fastener is detachably coupled to the first ends of the elastic bands and an accessory, such as a handle, bar, belt, ankle or foot band, etc., is attached to the second end of at least one of the elastic bands. The first fastener can be in the form of a length of material that has fasteners (e.g., pieces of hook and loop material) at the ends thereof to permit the first fastener to be attached around the support member. The attachment between the first fastener and the first ends is of a dynamic nature to allow the bands to freely pivot and move relative to the first fastener.

In one embodiment, the sleeve is openable along its length to allow the easy insertion and removal (in a lateral direction) of all or any of the elastic bands. For example, the sleeve can include a longitudinal slit that defines two opposing edges that include fastening elements (e.g., snaps, button, hook and loop material, etc.) that permit the sleeve to be sealingly closed around the elastic bands, thereby containing the bands therein and prevent the bands from interfering with the user and/or the exercise equipment to which the device is attached in one embodiment.

The accessory can be in the form of a handle that is fixedly attached to the second end of one or more elastic band and is not removable therefrom or the handle can be of a detachable type and include a coupling member to permit the handle to attach to more than one elastic band.

Other aspects, features and advantages of the invention will be apparent in view of the accompanying description of certain embodiments thereof when considered in connection with the accompanying drawing figures.

DETAILED DESCRIPTION OF CERTAIN EMBODIMENTS

Figure 1:
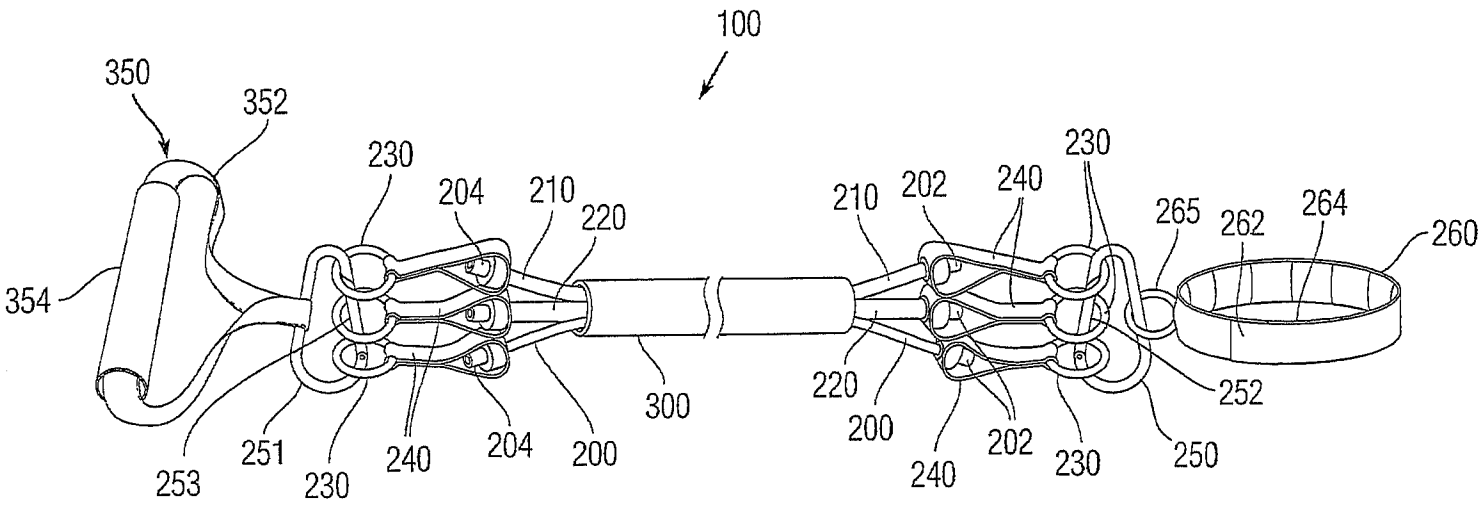
FIG. 1 is a perspective view of a portable modular exercise device according to one embodiment of the present invention.
Figure 5:
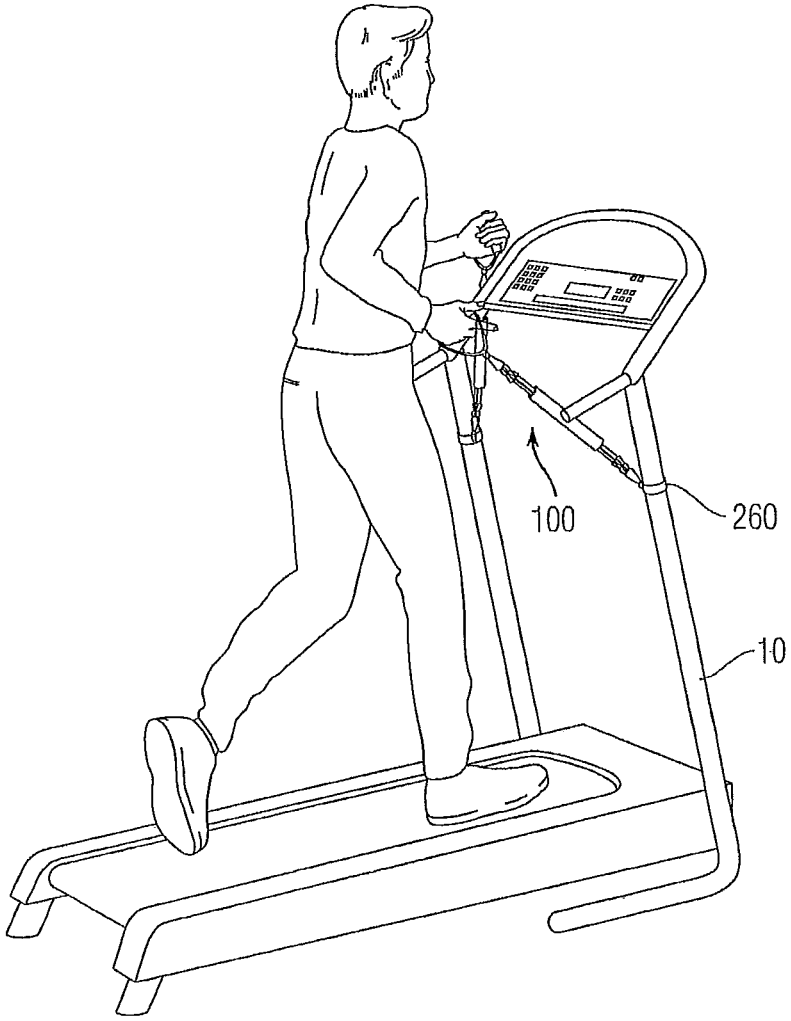
FIG. 5 is a perspective view of the portable modular exercise device of FIG. 1 attached to a piece of exercise equipment to provide an adjustable resistance, cardio and resistance toning workout for a user.

FIGS. 1 and 5 illustrate one embodiment of an exercise device 100 incorporating features of the present invention.

The exercise device 100 can be thought of as being an adjustable resistance multi-use toning system that can be used by a user in any number of different settings to perform any number of different exercises. More specifically and as described in detail below, the device 100 is configured to be used as an add-on (accessory) to other exercise devices, routines and methods. The device 100 increases the level of cardio workout (more calories consumed, easier to reach and maintain target heart rate) when used in conjunction with other exercise devices, routines and methods. The device 100 adds resistance training/muscle toning to a workout when used with other exercise devices, routines and methods. However, the device 100 can also be used as a standalone exercise device, without other exercise devices, routines and methods.

In accordance with the present invention, the exercise device 100 includes a number of complementary parts that mate together to form one of many different assembled states of the exercise device 100. The exercise device 100 includes a means for providing variable resistance to exercises such as an elastic band or cord (such as the ones commonly referred to as a resistance band or cable). Multiple resistance bands can be used to provide additional resistance to exercises and to alter the degree of resistance encountered by the user. In the Figures, the resistance bands are numbered 200, 210, 220 in the situation where up to three bands 200, 210, 220 are used. However, it will be appreciated that more than three or less than three resistance bands can be used in the practice of the present invention as will be appreciated by the following discussion. In other words, a single band can be used, two bands can be used or three or more can be used.

Though one embodiment of the exercise apparatus 100 uses elastic tubing for the resistance bands 200, 210, 220, it should be understood that one of skill in the art would recognize that any of a number of other materials could be used as a means for providing resistance to exercises, such as bungee cords, elastic bands, etc. Thus, the resistance bands 200, 210, 220 can be any commercially available rubber resistance tubes or any similar structure that can be elongated and offers resistance.

As also described herein, the exercise device 100 of the present invention can be provided with sets of multiple sized (multiple lengths) resistance bands 200, 210, 220 to allow the user to change the resistance bands based on the particular application (exercise) of the exercise device 100 and based on anatomical considerations of the user.

In the embodiment shown, the resistance bands 200, 210, 220 are made up of three elastic tubes of differing thickness and resistance which range, for example, from light to heavy. Resistance bands 200, 210, 220 that utilize a wide range of tubing thicknesses allow the doctor, therapist, trainer, or user to easily tailor the amount of resistance applied for each exercise. This ability to easily switch from light to heavy or any combination of resistance bands 200, 210, 220 is one of the advantages and features of the present product 100. It should be understood by one of skill in the art that any number of resistance bands can be used and any combination of resistance bands can be used to vary the resistance for exercises. Another advantage of the present invention is that the user can change one or more of the bands while the exercise device is being used by the user without the need to stop exercising as is the case with other devices. For example, a user can add a band to increase resistance as the user continues to exercise.

Each of the resistance bands 200, 210, 220 includes a first end 202 and an opposing second end 204. As will be appreciated herein, the first end 202 is designed to be coupled to a support structure 10 which can either in the form of a fixed member, such as a piece of exercise equipment or other support structure or alternatively, the support structure 10 can be in the form of a body part, such as an ankle, foot, etc. The opposite end 204 is intended to be grasped, directly or indirectly, by the user to perform the resistance (toning) exercise.

At the first end 202 of each resistance band 200, 210, 220 is a first connector or coupling member 230. The first connector or coupling member 230 can be any number of types of connectors that allow connection or coupling between the end 202 and another object. In the illustrated embodiment, the first connector 230 can be in the form of a ring shaped connector that is fixedly attached to the end 202. In the illustrated embodiment, the first connector 230 can be in the form of a ring (e.g., circular ring or D-shaped metal ring or plastic ring) that is attached to the end 202 either directly or by means of an intermediate connector 240 such as a strap (e.g., nylon strap) that is connected to the end 202 and has the ring 230 captured therein. It will be appreciated that the illustrated first connector 230 is merely one type of connector and it is within the scope of the present invention that other types of connectors can equally be used. The first connector 230 provides a means for connecting the individual bands 200, 210, 220 to another object as described herein.

The first connectors 230 at each of the first ends 202 provide a means for connecting the ends 202 to the support structure 10. In the illustrated embodiment, a first fastener or carabiner 250 is provided as part of the connection system for securely connecting the first ends 202 to the support structure 10. As is known, a carabiner 250 is a metal loop with a sprung swinging gate 252 that allows a member to be received within and along the loop. The first carabiner 250 can be opened by opening the gate 252 and the first connectors 230 associated with the bands 200, 210, 220 are received therein to securely attach the bands 200, 210, 220 to the first carabiner 250 when the gate 252 is closed.

Alternatively, each first end 202 can include a first carabiner 250 to permit direct attachment to another structure.

Another part of an exemplary connection system is an adjustable fastener or coupling member 260 that is constructed to securely receive and be coupled to the support structure 10.

In one illustrated embodiment, the adjustable fastener 260 is in the form of an elongated strip of flexible material that forms a band (e.g., fabric band) that can be attached about the support structure 10 and secured thereto.

The fastener 260 can be a strip of fabric (e.g., nylon) that is easily foldable and can be attached about the support structure 10. The fastener 260 has a first end 262 and an opposing second end 264, with the ends being constructed to attach to one another in a releasable manner. At the first and second ends 262, 264, hook and loop material can be provided to allow attachment of the first end 262 to the second end 264 by intimately contacting the ends to one another.

The fastener 260 is thus of the type that can be frilly opened so as to receive the support structure 10 within the open fastener 260 and then permit fastener 260 to be closed about the support structure. To secure the fastener 260 to the support structure 10, the fastener 260 (strap) is opened and then the strap is wrapped tightly around the support structure 10 and securely attached to itself by means of the hook and loop material.

The fastener 260 includes an integral coupling member 265 that allows the fastener 260 to be attached to the first (fastener) carabiner 250 similar to how the rings 230 mate with the first carabiner 250. As illustrated, the coupling member 265 can be in the form of a metal ring or the like that allows the fastener 260 to easily be attached and detached from the bands 200, 210, 220. When each first end 202 has a carabiner 250, the carabiner 250 mates with the member 265.

Similarly, at each of opposite second ends 204 of the bands 200, 210, 220, connector or coupling members are disposed to allow an accessory (as described below) to be attached thereto. In one embodiment, as shown, the connectors can be in the form of the connectors 230. In the illustrated embodiment, the first connector 230 is in the form of a ring shaped connector that is fixedly attached to the end 204. The first connectors 230 are attached to the end 204 either directly or by means of an intermediate connector 240 (as shown) such as a strap (e.g., nylon strap) that is connected to the end 204 and has the ring 230 captured therein. The first connector 230 provides a means for connecting the individual bands 200, 210, 220 to the user accessory as described herein.

The first connectors 230 at each of the second ends 204 provide a means for connecting the ends 204 to the support structure 10. In the illustrated embodiment, a second fastener or carabiner 251 is provided as part of the connection system for securely connecting the second ends 204 to a user accessory 350. The carabiner 251 is a metal loop with a sprung swinging gate 253 that allows a member to be received within and along the loop. The second carabiner 251 can be opened by opening the gate 253 and the connectors 230 associated with the bands 200, 210, 220 are received therein to securely attach the bands 200, 210, 220 to the second carabiner 251 when the gate 253 is closed.

The user accessory 350 is a component that can be grasped by the user to allow extension of the bands 200, 210, 220 by pulling the accessory 350 outwardly. In the illustrated embodiment, the accessory 350 is in the form of a handle that can be easily grasped by the user to allow the user to extend the bands 200, 210, 220 by pulling the second ends 204 outwardly, while the other ends 202 of the bands are securely fixed to the support structure 10.

The handle 350 can include a fabric strip 352 forming a loop and a tubular hand grip 354 constructed of a polymeric material and disposed about the strip 352. It will be appreciated that the illustrated handle 350 is merely one exemplary type of handle and any number of different types of handles can be used and designed to be held by the user. The handle 350 is coupled to the ends 204 of the bands 200, 210, 220 by means of the second carabiner 251.

The handle 350 construction permits the user to vary the degree of total resistance offered by the bands 200, 210, 220 by allowing the user to easily select which of the bands 200, 210, 220 are attached to the handle 350 by being securely captured within the same second carabiner 251 that captures the handle 350. For example, the user can attach one of the bands 200, 210, 220 to the second carabiner 251 or the user can select and attach two or more of the bands 200, 210, 220 to the second carabiner 251. In the illustrated embodiment, the band 200 is intended to offer the least resistance (light); the band 210 offers an intermediate level of resistance (medium); and the band 220 offers the greatest level of resistance (heavy). It will therefore be appreciated that the total resistance can easily be varied by combining different bands 200, 210, 220 due to each band having a different level of resistance. Thus, the combination of bands 200, 210 offers less resistance than the combination of bands 210, 220, etc. The design of the present product allows for the user to easily be able to change the level of resistance. The resistance can also be varied by adding or subtracting bands that each has the same resistance value in the case in which all of the bands have the same resistance value.

It will be understood that the elastic bands used in the present device can be all of the same resistance value in which case, the more bands that are attached to the accessory, such as a handle, increases the resistance. It will also be understood that the term accessory encompasses any member that is responsive to user movement and engages the band(s) to provide a workout to the user. For example and as described herein, the accessory can be a handle; bar; belt; loop; rope; ankle, leg or foot member, etc.

It will be appreciated that the handle 350 is thus constructed to allow the different bands to be easily connected thereto.

Other coupling arrangements are equally possible for attaching the handle to the second end of one or more of the bands.

In accordance with the present invention, the bands 200, 210, 220 are routed through a common sleeve or casing 300. The sleeve 300 is open at both ends to permit the bands 200, 210, 220 to be routed through the sleeve 300 and protrude from the opposite ends of the sleeve 300. The bands 200, 210, 220 can freely move within the hollow interior of the sleeve 300; however, the bands 200, 210, 220 preferably are intimately fit within the sleeve 300 so as to prevent the bands 200, 210, 220 from freely falling out of the sleeve 300.

The sleeve 300 thus has a construction that maintains the bands 200, 210, 220 in place within a common structure or casing. This prevents the bands from getting in the way of a surrounding object, such as exercise equipment. In the embodiment of FIG. 1, the sleeve 300 has a tubular structure and is formed of a polymeric material or rubber material, or any other suitable material. To insert or remove one or more bands, 200, 210, 220, the respective bands 200, 210, 220 are simply pulled through the sleeve 300 from one end thereof.

The sleeve 300 also provides the advantage that the bands 200, 210, 220 are constrained along a substantial portion of their lengths so as to prevent the bands 200, 210, 220 from interfering with the exercise routine of the user. The sleeve 300 also provides a level of padding and shields the user from the moving bands and also from the equipment (support structure).

FIG. 5 shows the device 100 attached to a piece of exercise equipment 10, in this case a treadmill, by attaching the fastener 260 to a generally vertical frame member of the equipment 10. However, it will be understood that the device 100 can equally be attached to a horizontal support structure, such as a horizontal frame member or bar and generally can be attached to any type of fixed support structure, including knobs, hooks, bars, beams, etc. regardless of the orientation thereof.

The opposite end, including the handle 350, is free to be grasped by the user to allow the user to freely and easily exercise while still standing on the treadmill 10. It will be appreciated that the user can exercise while the treadmill is not operating and the user simply is standing on the treadmill and in accordance with one of the main advantages of the present invention, the user can supplement one form of exercise by using the exercise device. In other words, the one form of exercise can be jogging on a treadmill and the supplemental form of exercise is a toning workout using the exercise device. The term supplemental is not limiting since the toning workout may be more strenuous than the underlying exercise, such as a walk on the treadmill.

Figure 2:
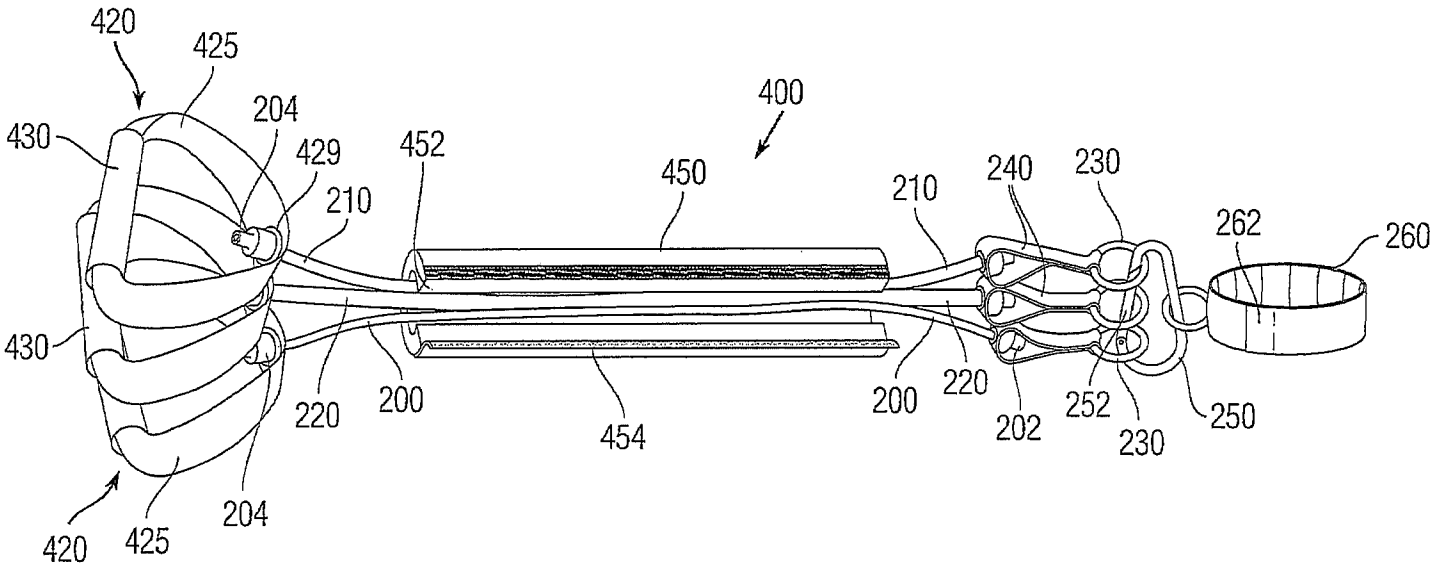
FIG. 2 is a perspective view of a portable modular exercise device according to another embodiment of the present invention.

FIG. 2 shows a device 400 that is very similar to the device 100 and therefore, like elements are numbered alike.

In this embodiment, each band 200, 210, 220 includes its own associated fixed handle 420. The handle 420 includes a fabric strip 425 forming a loop and defining a hole receiving one of the bands 200, 210, 220; a grommet 429 disposed about the hole and a tubular hand grip 430 disposed about the strip 425. The handle 420 is thus fixedly attached to the respective band 200, 210, 220 and is not removable therefrom. The user can vary the resistance of the workout by simply grasping a different band and/or by grasping more than one handle.

The device 400 includes a sleeve 450 that is openable along its length. In particular, the sleeve 450 includes a first longitudinal edge 452 and an opposing longitudinal edge 454 that are constructed to fasteningly attach to one another so as to form a closed tubular structure. For example, the first and second edges 452, 454 can include hook and loop material to permit the edges 452, 454 to mate together and attach to one another to form the closed structure.

This type of openable sleeve 450 allows the bands 200, 210, 220 to be easily inserted and removed therefrom by opening the sleeve 450 along its edges 452, 454 and then laterally inserting or removing the bands 200, 210, 220. The sleeve 450 thus resembles a clamshell type casing the opens along a living hinge.

The sleeve 450 can be formed of any number of different materials including polymeric materials, etc. In the illustrated embodiment, the sleeve 450 is formed of a fabric material (e.g., nylon) as an outer shell and has padding therein to provide not only thickness to the sleeve 450 but also to provide comfort in case a body part, such as a limb, of the user contacts the sleeve 450 during exercise. The padding can be contained within the sleeve such as by stitching, etc. The strips of hook and loop material are located along the edges 452, 454. The sleeve 300 also can be formed to provide padding to the user similar that described above and in any event, the sleeve 300 shields the user from the working elastic bands that are moving, etc.

It will also be appreciated that other types of fasteners can be used to attach the edges 452, 454 to one another to form a closed structure in which the bands nest. For example, suitable fasteners can include but are not limited to a zipper, snaps, buttons, etc.

The slit or opening formed in the sleeve 450 and the fastener features, in this case the hook and loop material, also allows the diameter (circumference) of the sleeve 450 to change and thus, a tight wrap can be formed around the bands 200, 210, 220 regardless of whether there are 1, 2, 3 or more bands and also regardless of the individual diameters of the bands. By wrapping the sleeve 450 around the bands until an intimate fit is formed and then fastening the edges 452, 454 together, the bands are fully contained within the sleeve such that lateral movement is limited; however, each band can freely undergo elongation and retraction as the user manipulates the bands themselves.

It will be fully understood and appreciated that the various components shown in the embodiments of FIGS. 1 and 2 can be readily interchanged. For example, the sleeve 450 of FIG. 2 can be used in the device 100 instead of the sleeve 300; the bands 200, 210, 220 of device 100 can of the type that includes individual fixed handles 420 as in FIG. 2; the bands of the device 400 of FIG. 2 can include the connectors and handles 350 shown in FIG. 1 and can include the sleeve 300; etc. The modular aspect of the devices disclosed herein allows individual parts to be readily changed to allow the user to customize and create exercise devices having different constructions. This allows an individual to customize the exercise device.

The various components described and illustrated herein can be provided in a kit or the like to allow a user the ability to customize the product based on any number of different considerations including but not limited to personal needs and also based upon the manner in which the product is secured to another object, etc.

Figure 3:
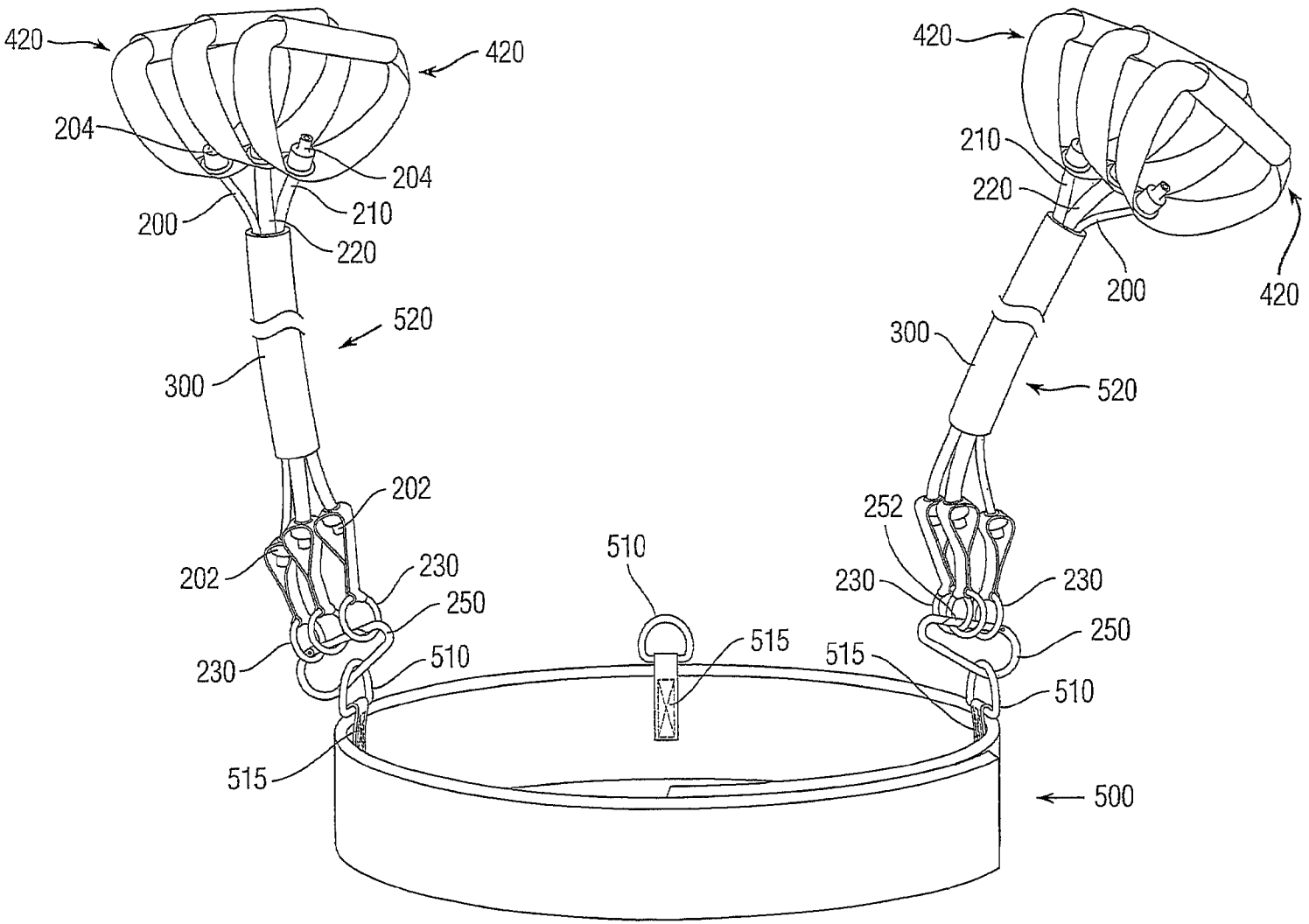
FIG. 3 is a perspective view of a portable modular exercise device according to another embodiment of the present invention.

FIG. 3 shows yet another embodiment in which a belt 500 serves as the support structure to which one end the exercise device according to the present invention is attached. The belt 500 can be in the form of a workout belt that is attached around a user's waist or around any other part of the user's body including but not limited to any limb, chest, head, etc., depending upon the exercise to be performed. For example, if a true sparring (boxing) experience is desired, the user can place the belt around the chest and then grasp the handles (accessories). Thus, true sparring action can be achieved when the belt is up on the chest so that the force of the "punches" comes from the shoulder and not the waist.

It will be understood that the belt 500 can be adjusted and slid up and down the body so that the angle of the bands can be adjusted. By moving the belt up and down the body, including thighs, different angles of movement of the resistance bands are achieved and different muscle groups can be exercised.

The belt 500 has two free ends that are attached to one another to form a snug fit around the user's waist. The belt 500 allows a user to walk or jog or otherwise exercise (including stationary exercise), while at the same time a resistance/muscle toning workout can be achieved with the exercise device.

The belt 500 also includes at least one and preferably a plurality of coupling members 510 that allow one or more exercise devices 520 according to the present invention to be attached thereto at one end thereof. The devices 520 of FIG. 3 are very similar to the devices 100, 400 and include three bands 200, 210, 220 encased within a sleeve 300 with fixed handles 420 at second ends 204 of each of the respective bands 200, 210, 220. The first ends 202 include coupling members 230 that are attached to the first carabiner 250. The coupling member 510 of the belt 500 can be in the form of a ring (e.g., metal D-ring) that is attached to the body of the belt 500 using a strap 515 or the like. The pivoting between the member 510 and the strap 515 allows the attached device 520 to have enough movement to allow the user to perform exercises, etc.

As in all of the embodiments disclosed herein, the number of elastic bands used in the exercise device can be 1, 2 or 3 or more.

To attach the device 520 to the belt 500, the user simply presses down the gate 252 of the first carabiner 250 and then inserts the coupling member 510 therein such that it is securely captured by the first carabiner 250. The end of the device 520 that is attached to the belt 500 thus represents the attached or fixed end of the device and the user grasps the handles 420 at the opposite end with his or her hand and then begins exercising as by pulling the handles 420 outwardly, etc. It will be understood that a leg band or foot band can also be used instead of a handle for grasping by a hand.

While FIG. 3 shows two of the same type of devices 520 being attached to the belt 500, it will be appreciated that two or more different types of exercise devices, similar or identical to devices 100, 400, 520 can be attached to the belt 500. This type of arrangement is beneficial when there is a lack of a support structure, like exercise equipment 10, to attach the device to, or when the device is used outside or in conjunction with walking, running, sparring, etc. As with the other embodiments, the user can easily interchange the different components that form the devices 520 so as to create a custom exercise device that is configured for attachment to the belt 500. The handles can thus be of a detachable type (FIG. 1) and are not limited to being fixed as shown.

Figure 4:
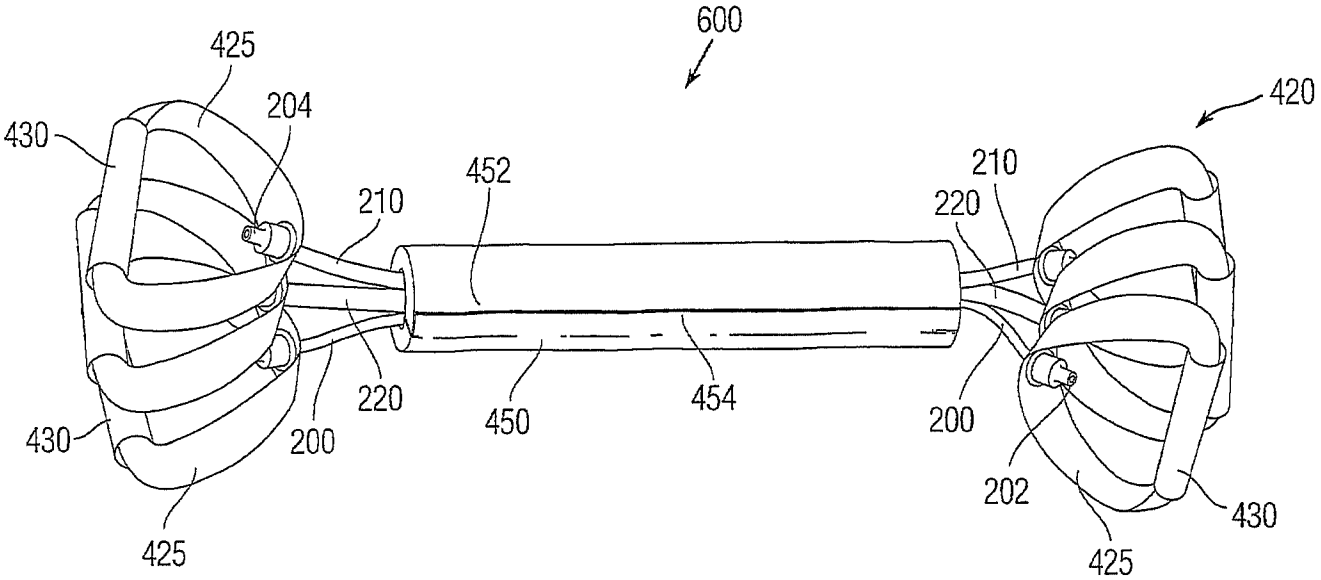
FIG. 4 is a perspective view of a portable modular exercise device according to yet another embodiment of the present invention.

FIG. 4 shows another embodiment of an exercise device 600 that includes components that were part of the devices previously described herein. In particular, the exercise device 600 includes the sleeve 450 that is openable along the edges 452, 454 and is fastenable therealong by means of a fastener, such as a hook and loop material or other fastener, such as a zipper, snaps, button, etc. At each of the ends 202, 204, the respective bands 200, 210, 220 include fixed handles 420 which have a construction previously described herein.

Figure 6:
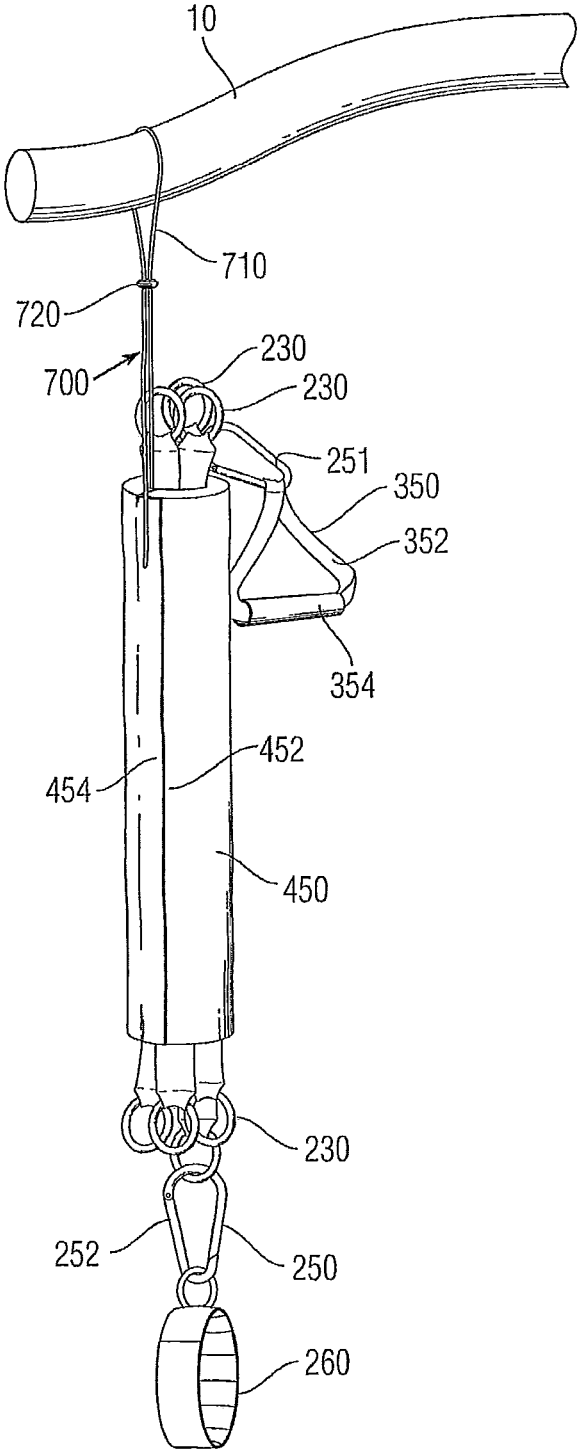
FIG. 6 is perspective view of a portable modular exercise device of FIG. 1 with an optional means for suspending the device by hanging/attachment to a support structure in a manner that permits the user to use the exercise device.

FIG. 6 (and the embodiment of FIG. 7) shows a means 700 for supporting and optionally storing the exercise device made in accordance with the present invention. The means 700 can in the form of an adjustable cord 710 that is attached at at least one end thereof to a portion (e.g., one end or proximate one end) of the sleeve 450. The cord 710 is looped and extends back through an adjustable cinch member (fastener) 720 that allows the size of the loop to be varied and fixed or locked in place. For example, both cords sections that form the loop are fed through the cinch member 720. The cinch member 720 is removable from the cord 710 and is adjustable along the length of the cord 710 by simply moving the cinch member 720 therealong to either tighten or loosen the loop. The loop is tightened about the support structure 10 which can be in the form of a piece of equipment.

In accordance with the present invention, the means 700 allows the other end of the sleeve to be secured in place while the exercise device is being used. For example, when the device is attached to a piece of equipment, one end of the sleeve 450 is attached to the equipment by means of the fastener 260, while the other end is attached to a different location of the equipment or even a different support structure by the means 700. This allows the main portion (the sleeve and nested cords) of the device to be secured and held generally in place during use and allows the user to let go of the accessory (handle) and then easily regrasp the accessory since the accessory is disposed within easy reach of the user due to the suspended nature of the device. The user can adjust the hanging (suspended) position of the sleeve by adjusting one or more of the location of the fastener 260 and length of the cord 710.

In addition, the product can even be hung on the support structure when not in use.

It will also be appreciated that the sleeve 450 can serve to hold the bands 200, 210, 220 as by folding the ends of the bands 200, 210, 220 internally into the interior of the sleeve 450, thereby forming a compact storage unit in which the bands 200, 210, 220 are stored. This allows for easy transportation thereof.

It will be appreciated that the exercise devices disclosed herein can come in any number of different lengths depending upon the intended application. For example, the a longer length version can be provided for use on exercise equipment, similar to the arrangement shown in FIG. 5; and a shorter length version can be provided for use with the belt 500 of FIG. 3.

There are a number of advantages provided by the exercise devices according to the present invention including the following. The exercise devices are designed for use on, and easy installation and removal on, multiple exercise devices and in multiple locations. For example, the exercise devices can be used in combination with exercise machines (e.g., treadmill, elliptical machine, stationary bicycle (recumbent and upright), stair climbing machines, etc.); the devices can be used on a person (e.g., on ankles for stationary exercise, on a belt for stationary, jogging, running, sparring, and other moving exercise); and at stationary locations (e.g., exercise bench in reclining and non-reclining positions, etc.).

Another advantage of the present exercise devices is that they utilize multiple, easily interchangeable resistance bands. The bands can be used independently or collectively in any combination safely and easily without stopping during the same workout. In addition, the handle that is used with the device can have an optional cover which permits the use of multiple bands with one padded handle. Bands can be used singly, or in any combination, with or without the padded cover.

In addition, it will be appreciated and understood that the fastening devices and techniques shown herein for attaching the resistance band to the main fastener 260 and to the handle(s) are merely exemplary in nature and are not limiting of the present invention since other fasteners can be used to accomplish the same.

Figure 7:
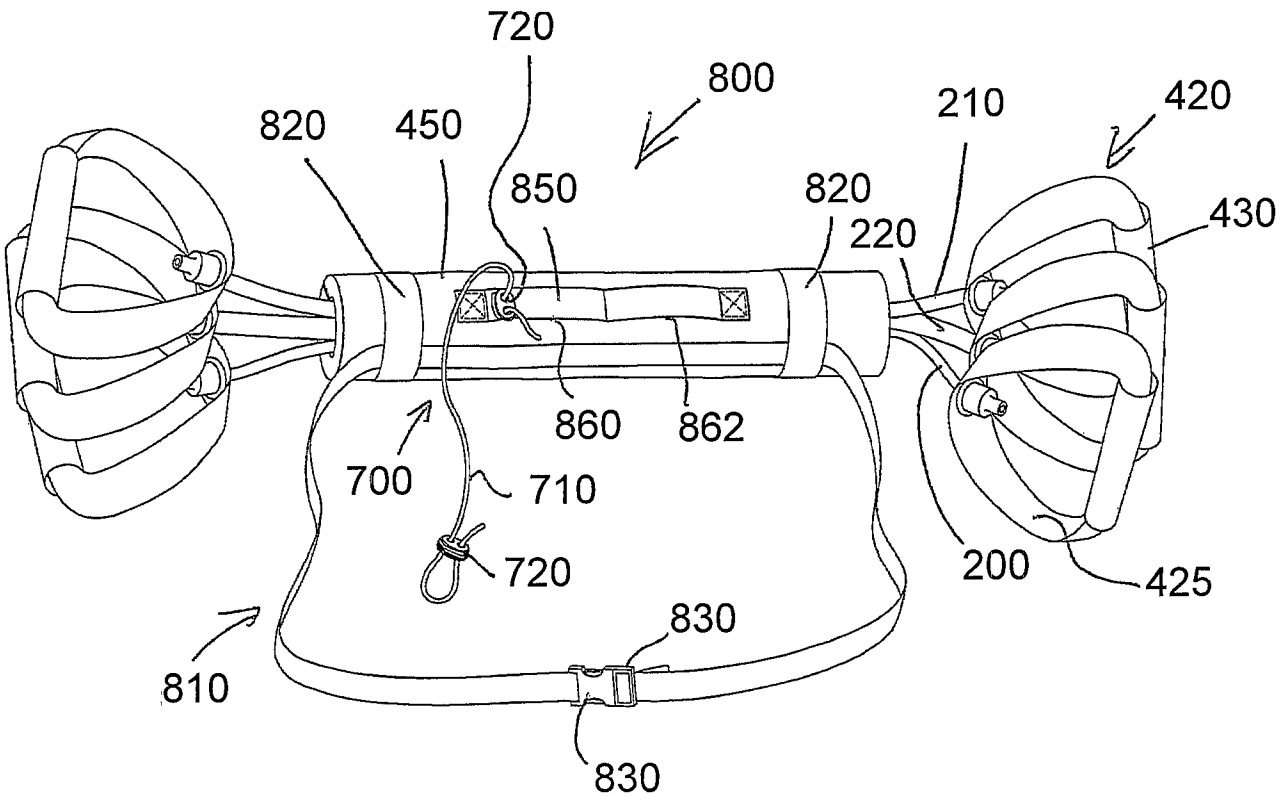
FIG. 7 is a perspective view of a portable modular exercise device according to yet another embodiment of the present invention.

FIG. 7 shows another embodiment of an exercise device 800 that includes components that were part of the devices previously described herein and therefore, like elements are numbered alike. In particular, the exercise device 800 includes the sleeve 450 that is openable along the edges 452, 454 (FIG. 2) and is fastenable therealong by means of a fastener, such as a hook and loop material or other fastener, such as a zipper, snaps, button, etc. Bands 200, 210, 220 including fixed handles 420 are routed through the sleeve 450 as previously discussed and it is further understood that the sleeve 450 shown in FIG. 7 can be used in any of the application discussed herein including those application in which first ends of the cords are attached to an object, such as a piece of equipment or around the body of the user.

It will also be understood and appreciated that the sleeve used in the device 800 can be of a non-openable type, such as sleeve 300 in FIG. 1, or can be a sleeve having some other construction.

The device 800 is constructed such that it can mate with a detachable belt 810 that is intended to be worn around a body part, such as around the user's waist, chest, limb (leg, etc.), etc. In the illustrated device 800, the sleeve 450 includes a pair of belt retaining members 820 that are coupled to the outer surface of the sleeve 450 proximate the two ends of the sleeve 450. The belt retaining member 820 can be in the form of a pair of straps, such as nylon straps or the like, that are attached at their opposing ends to the outer surface of the sleeve 450. In the case of the sleeve 450, the ends of the strap 820 are spaced from the edges 452, 454 (see FIG. 2) so as to not interfere with opening and closing of the sleeve 450. The strap 820 can thus have a C shape. There is play along the length of the strap 820 in that a user's finger or a small object can be disposed in the space between the strap 820 and the sleeve 450.

In particular, the belt 810 is able to be disposed underneath each strap 820 so as to allow the belt 810 to be routed across a length of the sleeve 450. The belt 810 can be any number of different types of belt that are intended to be fastened about a user's body. In the illustrated embodiment, the belt 810 includes two opposing ends that include fasteners 830 or the like that permit the ends of the belt 810 to be attached to another. Preferably, the length of the belt 810 is adjustable. In the illustrated embodiment, the fasteners 830 are snap fit type fasteners.

When the device 800 is worn around the user's waist, the sleeve 450 is worn around the lower back of the user and the fasteners 830 are in front.

The belt 810 can be completely detached from sleeve 450 by simply detaching the connectors/fasteners 830 and pulling one end of the belt 810 so as to pull the belt through the spaces underneath the retaining members 820.

The belt 810 allows the sleeve 450 to be worn around the user's body to allow any number of the exercises described herein to be performed.

The sleeve 450 also includes another second retaining member 850 that is attached to the outer surface of the sleeve 450. As shown, the second retaining member 850 extends longitudinally along a length of the sleeve 450. In the illustrated embodiment, the member 850 is in the form of an elongated strap (fabric, etc.) 850 that is attached to the sleeve 450 at three locations, namely at its two ends and at an intermediate location, so as to create two pockets 860, 862 underneath the strap 850. The pockets 860, 862 allow a belt, such as belt 810, to be routed through one of the pockets 860, 862 to allow the sleeve 450 to be oriented vertically on the body (e.g., and permit one of the cords to be attached to a piece of equipment or a body part (e.g., leg)).

FIG. 7 also shows the means 700 attached to the strap 850. As mentioned before, the means 700 can in the form of an adjustable cord 710 that is attached at one end to strap 850. At this end, the end can be looped about the strap 850 and through a cinch member 720 to attach this end to the strap 850. The other end of cord 710 is also looped through a second cinch member (fastener) 720 that allows the size of the loop to be varied and fixed or locked in place. For example, both cords sections that form the loop are fed through openings of the cinch member 720 when a side actuator (button or tab) is pushed and conversely, when the user releases the side actuator, the cord 710 is locked in place. This other end of the cord 710 allows the sleeve 450 to be coupled to a structure such as a piece of equipment, as discussed previously with respect to FIG. 6.

It will also be appreciated that the means 700 can be attached to one of the straps 820 instead of the strap 850.

Figure 8:
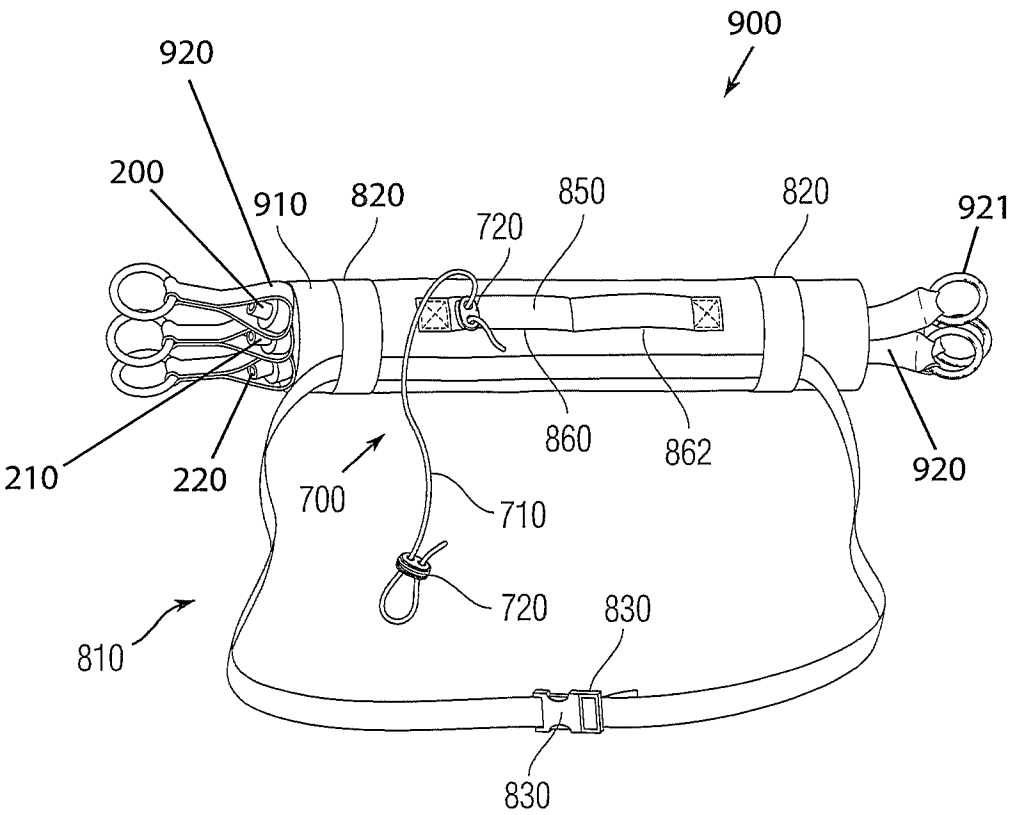
FIG. 8 is a top perspective view of a portable modular exercise device according to yet another embodiment of the present invention.

FIG. 8 shows an exercise device 900 that is similar to the other exercise devices disclosed herein and can include the components shown in the figure. The exercise device 900 is similar to device 800 and includes a sleeve 910 which can be an openable sleeve, such as sleeve 450, or can be non-openable sleeve, such as the ones described herein (see sleeve 300 in FIG. 1). For purposes of illustration only, the sleeve 910 is an openable sleeve like sleeve 450 (i.e., it has a slit running the entire length thereof). The sleeve is thus openable along the edges 452, 454 (FIG. 2) and is fastenable therealong by means of a fastener, such as a hook and loop material or other fastener, such as a zipper, snaps, button, etc. The hanging (suspending) means 700 can also be included in the device 900.

As in the previous embodiments, one or more bands 200, 210, 220 are disposed within the sleeve 910. As described herein, the bands can be of types that are attachable to an accessory, such as a handle or other piece of equipment, or they can be of the types that have a fixed handle already attached thereto.

The sleeve 910 can also include the second retaining member 850 that is attached to the outer surface of the sleeve. As shown, the second retaining member 850 extends longitudinally along a length of the sleeve. In the illustrated embodiment, the member 850 is in the form of an elongated strap (fabric, etc.) 850 that is attached to the sleeve at three locations, namely at its two ends and at an intermediate location, so as to create two pockets 860, 862 underneath the strap 850. The pockets 860, 862 allow a belt, such as belt 810 (FIG. 7), to be routed through one of the pockets 860, 862 to allow the sleeve to be oriented vertically on the body (e.g., and permit the user to use the device with both hands without the need to attach the device to another body part of fixed point).

In accordance with one aspect of the present invention, the sleeve 910 is constructed such that it covers a significant and preferably a substantial length of the bands 200, 210, 220 that are disposed within and contained by the sleeve 910. This is in contrast to conventional belt-like devices in which the exercise bands are only minimally contained within the sleeve-like structure. In other words, in the conventional exercise products, most of the elastic bands are disposed outside of the sleeve-like structure and this arrangement has a number of associated disadvantages. First, in the conventional exercise devices, the body of the user is exposed to a much greater extent (relative to the present invention) to moving elastic bands as a result of most of the elastic bands being located outside of the sleeve-like structure. Elastics bands that are in motion and in contact with the user's body can lead to skin burn and otherwise cause the user to be in discomfort. The bands are also more exposed to the surroundings and this can potentially lead to damage to the bands themselves or can result in premature wear of the bands.

Second, the conventional devices also fail to assist in defining the trajectory of the bands that is intended as part of performing a particular exercise. In other words, when most of the elastic bands are outside of the sleeve-like structure, as in the prior art devices, the user can grasp the end of one or more bands and pull; however, the direction of pulling (trajectory) is vast since the sleeve-like structure does not assist in defining the trajectory of the elastic band(s) as it is being pulled.

This can result in the user wildly pulling the band(s) in an out of control manner without any guidance or alignment being imparted by the sleeve-like structure due to its small size relative to the long elastic bands. Such action can potentially lead to injury of the user (e.g., sore or dislocated joint due to improper extension of body part). The correct alignment of the bands is desired in order for optimizing exercise efficiency and effect.

For example, if the band(s) is attached to an ankle (using a cuff accessory, etc.) and there is a lack of coverage of the band(s) by the sleeve, the band(s) will rub against the leg during exercise. In addition, when pulling straight up on a band that is attached at one end to a machine (exercise equipment), the band(s) can rub against the equipment and without sufficient coverage by the sleeve and this can lead to deterioration and possible failure of the band(s). The sleeve of the present invention with its substantially increased coverage over the elastic band(s) creates and defines a trajectory direction to assist the user in a controlled exercise motion.

In accordance with one embodiment of the present invention, the sleeve 910 is constructed such that covers greater than 50% of a length of the band when the band is in a normal, rest position; in another embodiment, the sleeve covers greater than 60% of the length of the band; in another embodiment, the sleeve covers greater than 70% of the length of the band; in another embodiment, the sleeve covers greater than 80% of the length of the band; in another embodiment, the sleeve covers greater than 90% of the length of the band, etc.

In another embodiment, the lengths of the elastic bands are selected such that in the normal rest position of the exercise device, the elastic bands are held within the sleeve under some tension. In other words, the elastic bands are slightly stretched within the sleeve. This can result due to the construction of the ends of the sleeve and/or the constructions of the ends of the band(s) in that, as shown in FIG. 8, each band can contain a coupling member 920 at one or more ends for attaching the band to another object (e.g., an accessory, machine/equipment, etc.). The coupling member 920 can itself be coupled to another coupling member 921 (e.g., a ring as shown in FIG. 8) which allows the respective band to be readily attached to some other object, such as a piece of equipment, a handle, etc. The lengths of the band(s) and the sleeve are thus selected such that the band(s) is placed in some tension (i.e., it is elongated at least partially from its rest position) when the band(s) is disposed within the sleeve. This results in the elastic band being drawn within the interior of the sleeve and eliminates having loose band ends that protrude beyond the sleeve.

Instead, in this embodiment, the ends of the band(s) are at least partially (or fully) contained within the sleeve (the coupling members 920 are at least partially exposed beyond the ends of the sleeve 910). Thus, according to this embodiment, the sleeve covers greater than 95% of the length of the band and in some cases can cover the entire length of the band (when the band is in the rest position).

In the embodiment of FIG. 8 and those described herein, the sleeve provides extensive coverage of the band(s) that are contained within the sleeve both during a normal rest position of the product and during use of the product. For example, when the user is exercising by pulling one end of the band(s), the sleeve can be positioned across the user's body to shield and protect the user from the continuously moving band(s). The sleeve also provides guidance (alignment) by containing the band(s) along greater lengths thereof.

Figure 9:
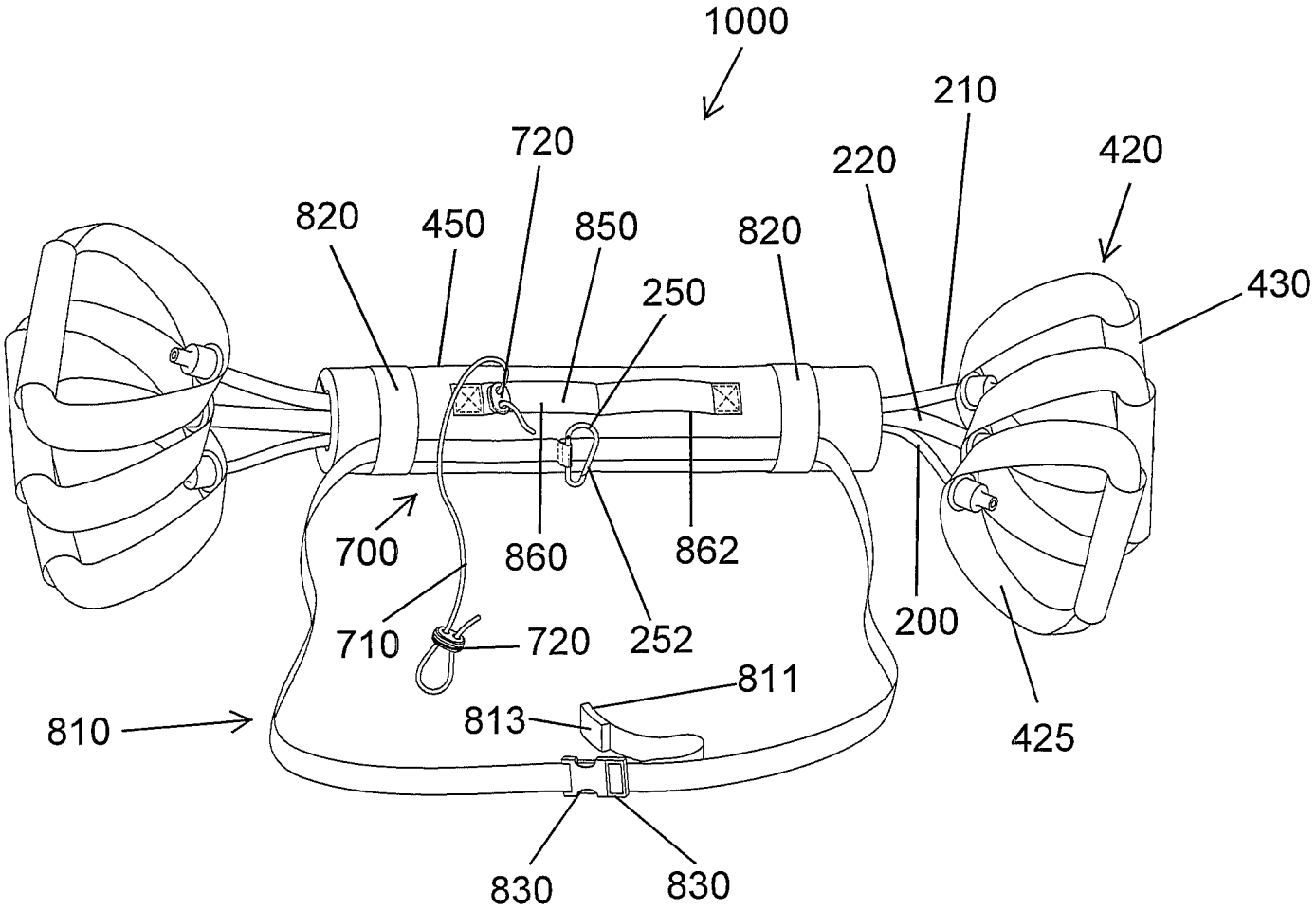
FIG. 9 is a perspective view of a portable modular exercise device according to another embodiment of the present invention.

FIG. 9 shows a device 1000 that is very similar to the device 800 that is shown in FIG. 7. The main difference between the device 1000 and the device 800 is that the detachable belt 810 shown in FIG. 9 includes several different features to allow the belt 810 to be used in a number of different applications. In particular and according to one embodiment, the belt 810 can be used as a traditional belt and worn about the waist of a user. In this use, the ends of the belt are connected by mating the two fasteners (connectors) 830 and then to adjust (e.g., tighten) the belt 810, a free end 811 of the belt 810 can be pulled, thereby causing a reduction in the circumference of the belt 810. In this first use, the device 800 can be worn around the waist of the user (by means of the belt 810), while the user's hands are free to grasp handles (accessories) that are located at both ends of the elastic bands.

In a second use or application of the device 1000, the belt 810 is coupled to a door frame, thereby securing the belt 810 to a fixed structure, while allowing the user to exercise with the elastic bands as once again by allowing the hands of the user to grasp handles or accessories that are disposed at both ends of the elastic bands. To facilitate the attachment of the device 1000 to the door frame, the free end 811 of the belt 810 can include a door stopper member 813 (door lanyard or anchor). The door stopper member 813 is in the form of enlarged section of the belt that is positioned on one side of the door, with the strap extending through the crack between the door and its frame when the door is shut. The size of the stopper member prevents the strap (belt) from freely being pulled through the door crack. The door stopper member 813 can be in the form of a layered belt structure (e.g., folding the end 811 of the belt and then stitching it closed) or the member 813 can be a solid mass that is supported on and carried by the belt 810.

In a third use or application of the device 1000, the belt 810 is coupled to another object, such as a fixed piece of equipment using a fastener 1010 that is attached along the length of the device 1000. The fastener 1010 is coupled/attached to the belt 810 in such a way that its location is fixed relative to the belt 810. In other words, the fastener 1010 is not free to move along the belt 810. The fastener 1010 is of a type that permits the belt 810 to be attached to the object in a releasable manner. One type of fastener 1010 is a carabiner, such as carabiner 250 shown in the other figures of the present application. Once the gate 252 of the carabiner 250 opens, it allows attachment to another object, such as a piece of equipment. It will also be appreciated that the belt 810 is coupled to the sleeve 450 in such a way that the belt 810 can be moved along and relative to the sleeve. In other words, the belt 810 can be slid along the sleeve to allow repositioning of the fastener (carabiner 250). For example, the belt 810 can be slid so as to position the carabiner 250 in a location that is spaced from the sleeve itself (e.g., the carabiner 250 can be moved so as to assume the position of the connectors 830 in FIG. 9). This allows the belt 810 to be easily attached to an object (e.g., piece of equipment) using the carabiner 250, thereby allowing both ends of the elastic bands to be free for grasping by the user.

It will also be appreciated that the sleeve 450 can be formed so as to have more of a flat appearance compared to the more tubular construction shown in the figures. More specifically, the sleeve 450 can be formed of a split fabric structure which is foldable and lies generally flat when in its closed position. More specifically, the fabric structure has a base portion (which preferably includes comfort padding on its exterior surface) and has two foldable flaps (side wall structures) that fold along lines that defines the longitudinal edges of the base portion. The elastic bands (200, 210, 220) are laid along the base portion with the flaps being open and then the flaps are folded over to capture the elastic bands and are removably attached to either each other or to the base portion, thereby capturing the bands. However, to remove the bands, the sleeve is simply open by opening up the two flaps. One advantage of this flat split sleeve construction is that the sleeve can be folded transversely (across its width) to allow it to be more compact for storage and/or transportation.

It will also be appreciated that in FIG. 9, one type of elastic band structure is shown for use with the sleeve 450; however, any of the elastic bands 200, 210, 220 shown herein can be used with the sleeve of FIGS. 7 and 9. In other words, FIGS. 7 and 9 show a dual handle elastic band structure; however, the elastic band structure of FIG. 1 (or any other figure for that matter can be used) in which handles are not permanently attached to the ends of the bands. Thus, instead of permanent handles at both ends as in FIG. 9, a removable handle structure (see FIG. 1) can be used at one or both ends of the elastic bands (or alternatively as in FIG. 4, permanent handles can be present at each end).

The invention is described in detail with reference to a particular embodiments thereof, but the scope of the invention is to be gauged by the claims that follow and also by those modifications that provide equivalent features to those that are claimed as such modifications are still within the spirit and scope of the invention.

What is claimed is:

1. An exercise device comprising:

at least one elongated elastic band, the band having a first end and an opposing second end;

a sleeve that receives at least a portion of each elastic band so as to at least partially envelope the elastic band while permitting the first and second ends to be accessible, wherein the sleeve has at least one retaining member; and a removable belt that is directly coupled to the sleeve by the at least one retaining member and is in direct contact with the sleeve and runs along a substantial length of the sleeve, the belt having two free ends with connectors at each end of the two free ends to allow attachment of the belt about a waist of a user, wherein one end of the belt is adjustable relative to the respective connector to allow the circumference of the belt to change, wherein the removable belt includes a fastener that is at a fixed location along the removable belt at a location between the two free ends, the fastener being configured to permit attachment of the belt to an object, wherein the at least one retaining member is configured such that the removable belt is permitted to slidably travel along an outer surface of the sleeve and in a longitudinal direction relative to the sleeve so as to change a relative position of the removable belt to the sleeve, while at the same time maintaining the coupling between the belt and the sleeve and contact between the sleeve and the removable belt.

2. The exercise device of claim 1, wherein the sleeve is openable along its length so as to permit the elastic bands to be inserted and removed from the sleeve, wherein the sleeve includes a longitudinal slit that defines a first longitudinal edge and an opposing second longitudinal edge.

3. The exercise device of claim 2, wherein the first and second longitudinal edges are closed with respect to one another when the sleeve assumes a closed position.

4. The exercise device of claim 3, wherein the sleeve includes complementary fasteners for securely closing the first longitudinal edge with respect to the second longitudinal edge.

5. The exercise device of claim 1, wherein both ends of the elastic band has a handle structure connected thereto.

6. The exercise device of claim 5, wherein the handle structures are detachably connected to the ends of the elastic band.

7. The exercise device of claim 1, wherein the fastener comprises a carabiner that has an openable gate.

8. The exercise device of claim 1, wherein the sleeve contains a plurality of elongated elastic bands.

9. The exercise device of claim 1, wherein one end of the belt that is adjustable relative to the respective connector includes a door stopper member that comprises a section of the belt that has increased thickness.

10. The exercise device of claim 1, wherein the at least one retaining member comprises a pair of spaced apart straps that extend transversely across the sleeve and the belt passes underneath the straps and is slidable relative to the straps and sleeve.

* * * * *